United States Patent [19]

Anand et al.

[11] Patent Number: 5,063,021

[45] Date of Patent: Nov. 5, 1991

[54] METHOD FOR PREPARING POWDERS OF NICKEL ALLOY AND MOLYBDENUM FOR THERMAL SPRAY COATINGS

[75] Inventors: Vidhu Anand; Sanjay Sampath, both of Sayre; Clarke D. Davis, Wyalusing; David L. Houck, Towanda, all of Pa.

[73] Assignee: GTE Products Corporation, Stamford, Conn.

[21] Appl. No.: 527,456

[22] Filed: May 23, 1990

[51] Int. Cl.[5] ..... G22F 1/00

[52] U.S. Cl. ..... 419/12; 75/252; 75/255; 419/23; 419/26; 419/29; 419/33; 419/46; 419/57

[58] Field of Search ..... 75/252, 255; 419/12, 419/23, 33, 46, 57, 26, 29

[56] References Cited

U.S. PATENT DOCUMENTS

| | | | |
|---|---|---|---|
| 3,945,863 | 3/1976 | Precht | 419/23 |
| 4,123,266 | 10/1978 | Foley et al. | 419/10 |
| 4,129,444 | 12/1978 | Dreyer et al. | 419/12 |

*Primary Examiner*—Stephen J. Lechert, Jr.

*Attorney, Agent, or Firm*—L. Rita Quatrini; Robert E. Walter

[57] ABSTRACT

A method is disclosed for preparing an intimate mixture of powders of nickel-boron-silicon alloy and molybdenum metal powder suitable for thermal spray coatings which comprises milling a starting mixture of the alloy and molybdenum powder to produce a milled mixture wherein the average particle size is less than about 10 micrometers in diameter, forming an aqueous slurry of the resulting milled mixture and a binder which can be an ammoniacal molybdate compound or polyvinyl alcohol, and agglomerating the milled mixture and binder. The intimate mixture and binder are preferably sintered in a reducing atmosphere at a temperature of about 800° C. to about 950° C. for a sufficient time to form a sintered partially alloyed mixture wherein the bulk density is greater than about 1.2 g/cc. The resulting sintered mixture is preferably entrained in an inert carrier gas, passed into a plasma flame wherein the plasma gas can be argon or a mixture of argon and hydrogen, and maintained in the plasma flame for a sufficient time to melt essentially all of the powder particles of the sintered mixture to form spherical particles of the melted portion, and to further alloy the sintered mixture, and cooled.

9 Claims, 6 Drawing Sheets

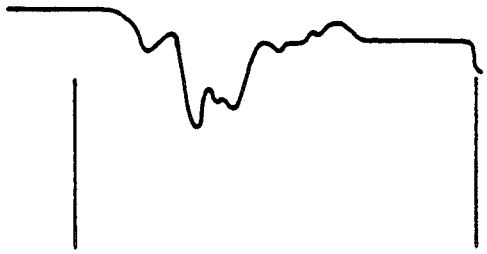
CONVENTIONAL
FIG. 4A
PRESENT INVENTION

METHOD FOR PREPARING POWDERS OF NICKEL ALLOY AND MOLYBDENUM FOR THERMAL SPRAY COATINGS

BACKGROUND OF THE INVENTION

This invention relates to a method for preparing powders of nickel alloy and molybdenum which involves milling and agglomerating, most typically followed by sintering and plasma processing. The resulting powder when used in thermal spray coating applications produces coatings which are much more uniform and have lower wear rates and friction coefficients when compared to coatings made from blends prepared by prior methods.

Blended powders of molybdenum and nickel self fluxing alloys are commonly used to produce thermal or plasma sprayed coatings for various applications including piston rings for internal combustion engines. Typically these blends consist of spray dried or densified molybdenum and atomized nickel alloys. When plasma sprayed to produce coatings, the coating microstructure shows large islands of molybdenum and nickel alloy. The size of these islands is controlled by the starting size of the individual component, namely Mo and Ni alloy. This macrosegration has its advantages and disadvantages. For instance large unreacted Mo islands are desirable because they provide the low friction coefficient (due to oxide film formation) which is advantageous for piston ring applications. The large Ni alloy rich regions provide wear resistance. However in coatings made from such powders, while the wear rate is good, once the wear process is initiated, the progagation takes place quite rapidly because the pull-out regions are large.

Therefore it would be desirable to reduce the macrosegregation effects in order to improve overall wear characteristics of thermal spray coatings.

SUMMARY OF THE INVENTION

In accordance with one aspect of the invention, there is provided a method for preparing an intimate mixture of powders of nickel-boron-silicon alloy and molybdenum metal powder suitable for thermal spray coatings which comprises milling a starting mixture of the alloy and molybdenum powder to produce a milled mixture wherein the average particle size is less than about 10 micrometers in diameter, forming an aqueous slurry of the resulting milled mixture and a binder which can be an ammoniacal molybdate compound or polyvinyl alcohol, and agglomerating the milled mixture and binder.

In accordance with another aspect of the invention, the intimate mixture and binder are sintered in a reducing atmosphere at a temperature of about 800° C. to about 950° C. for a sufficient time to form a sintered partially alloyed mixture wherein the bulk density is greater than about 1.2 g/cc.

In accordance with another aspect of the invention, the resulting sintered mixture is preferably entrained in an inert carrier gas, passed into a plasma flame wherein the plasma gas can be argon or a mixture of argon and hydrogen, and maintained in the plasma flame for a sufficient time to melt essentially all of the powder particles of the sintered mixture to form spherical particles of the melted portion, and to further alloy the sintered mixture, and cooled.

DETAILED DESCRIPTION OF THE INVENTION

Figure 1A:
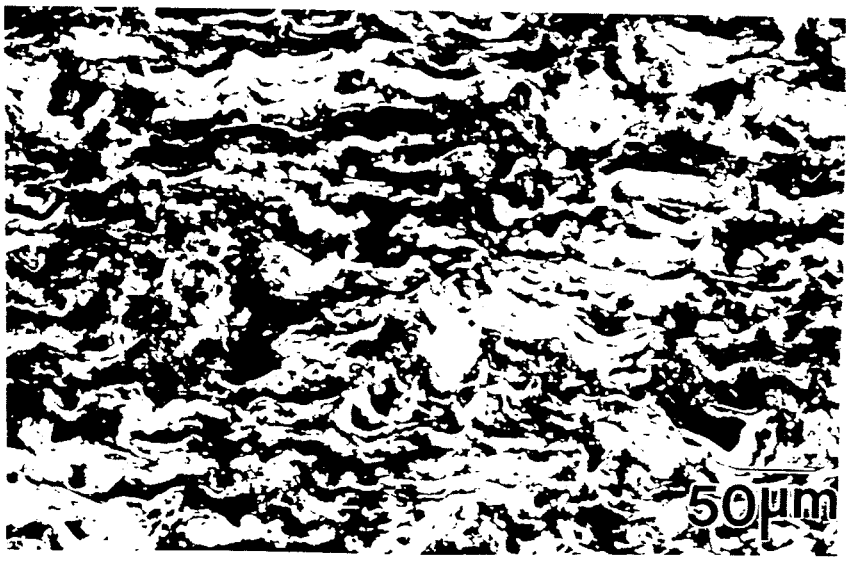
FIG. 1*a* is an optical micrograph at 200× magnification showing a coating made from powders produced by prior blending methods.

For a better understanding of the present invention, together with other and further objects, advantages and capabilities thereof, reference is made to the following disclosure and appended claims in connection with the above described figures and description of some of the aspects of the invention.

The present invention provides powders of molybdenum metal and nickel alloy which when used in thermal spray applications result in coatings which have a unifrom microstructure which is essentially free of macrosegregation. This results in high wear resistance in the coatings.

The starting materials of the present invention are molybdenum metal powder and nickel alloy powder. The molybdenum metal powder is typically low in oxygen, that is having typically less than about 5000 weight ppm oxygen. One preferred source of molybdenum metal powder is supplied by GTE Corporation under the designation of Type 150. The nickel alloy powder is Ni-B-Si alloy. The typical composition of this alloy is preferably in percent by weight about 1 to about 20 chromium, about 2 to about 5 boron, about 2 to about 5 silicon, about 0.1 to 2 carbon, and the balance nickel.

A starting mixture is formed of the alloy and the molybdenum metal powder. The composition of this mixture is typically about 10% to about 50% by weight of the alloy and the balance being the molybdenum powder, and preferably about 20% to about 40% by weight of the alloy and the balance being the molybdenum powder. The Mo and nickel alloy are normally first dry blended to form the starting mixture.

The Mo and Ni alloy starting mixture is then milled. The milling is done by techniques known in the art, and can be dry or wet milled. However, the preferred method is attritor milling typically using water as the milling fluid. The milling is done for a sufficient time to result in an average particle size in the powder of less than about 10 micrometers in diameter.

After the milling operation a material which is to serve as a binder in the subsequent agglomeration step is blended with the milled material. The binder can be an ammoniacal molybdate compound or polyvinyl alcohol (PVA). Usually the binder is chosen depending on the oxygen content desired in the final product powder.

Oxygen affects certain properties in the coatings such as hardness. The higher oxygen levels increase coating hardness. For example if an oxygen content of greater than about 1% by weight is desired, an ammoniacal molybdate compound is used which is typically ammonium paramolybdate or ammonium dimolybdate but is preferably ammonium paramolybdate (APM). If an oxygen content of less than about 1% by weight is desired, polyvinyl alcohol is used. Therefore some desired properties can be attained in the coatings by controlling the oxygen content with the proper binder. The binder is blended with the milled material by forming an aqueous slurry of the milled material and the binder. If the material was wet milled, the milling fluids can serve as the slurry medium. The water content of the slurry is sufficient so that it can be easily agglomerated in the subsequent processing. Usually the slurry is made of about 45% to about 70% by weight solids.

The milled mixture and binder are then agglomemrated to form the intimate mixture. The agglomerating is done preferably by spray drying by known methods.

The resulting intimate mixture of nickel alloy and molybdenum metal powder can be used in thermal spray applications such as plasma spraying and high velocity flame spraying to produce coatings which have good wear properties and low friction coefficients.

The resulting agglomerated mixture can be screened typically through 60 mesh screens to remove out-of-size material, if desired.

The agglomerated material can be sintered if desired to form a partially alloyed mixture. The sintering is done in a reducing atmosphere preferably hydrogen at a temperature of about 850° C. to about 950° C. and preferably about 900° C. to about 940° C. for a period of time of typically about 1 hour to about 2 hours. The sintering results in an increase in the bulk density of the powder. The bulk density of the sintered powder is normally greater than about 1.2 g/cc and most typically about 1.5 to about 2.0 g/cc.

The resulting sintered powder mixture can be plasma processed if desired as follows to further densify and to further alloy the sintered mixture. The sintered powder is entrained in an inert carrier gas. The carrier gas is preferably argon or a mixture of argon and helium. The sintered powder and carrier gas are passed through a plasma flame. The plasma is an inert gas which is preferably argon or a mixture of argon and helium. The carrier gas and plasma gas must be inert to avoid any reactions of the powder. The powder is maintained in the plasma flame for a sufficient time at a temperature above the melting point of the powder to melt essentially all of the powder particles and form spherical particles of the melted portion.

Details of the principles and operation of plasma reactors are well known. The plasma has a high temperature zone, but in cross section the temperature can vary typically from about 5500° C. to about 17,000° C. A typical plasma incorporates a conical thoriated tungsten cathode, a water cooled annular copper anode which also serves as a nozzle, a gas injection system and a power injection system. Gases used are selected for inertness and/or energy content. These gases include but are not limited to argon, hydrogen, helium, and nitrogen. Plasma gun operating power levels are generally in the 15 to 80 KW range. The location of the powder injection port varies with the nozzle design and/or powder material. It is either in the nozzle (anode) throat (internal feed) or downstream of the nozzle exit (also called external feed). The plasma jet is not a uniform heat source. It exhibits steep temperature (enthalpy) and velocity gradients which determine the velocity and temperature achieved by the injected powder particles (agglomerates). In addition, the particle trajectories (and hence the temperature and velocity) are affected by the particle size, shape and thermophysical properties. The particle temperature is controlled by appropriately selecting the plasma operating conditions (plasma gas composition and flow rate and plasma gun power) and the injection parameters (injection port location and carrier gas flow rate). In accordance with the present invention the powder can be fed into the plasma through the internal or external feeding mechanisms. However, the internal feeding is the preferred mode.

The resulting plasma processed material is then cooled by standard techniques for this type of processing.

The resulting plasma densified material can be screened and classified to obtain the desired particle size and distribution.

The powder prepared by the method of the present invention exhibits a microstructure that has a fine and uniform dispersion of the Mo and nickel alloy when compared to prior blended powder. Thermal spray coatings produced using the powder of the present invention have improved wear and friction properties over coatings produced by conventional blending methods.

To more fully illustrate this invention, the following non-limiting example is presented.

EXAMPLE

Molybdenum powder Type 150 by GTE is mixed with a Ni-15Cr-3B-4Si-3Fe alloy at about 20% to 40% by weight of the alloy and the balance being the molybdenum powder. The mixture is attritor milled for about 1½ to about 2 hours until the particle size of the mixture is less than about 10 micrometers in diameter. The resulting attritor milled powder is blended with about 18.7 pounds of ammonium paramolybdate and about 5 gallons of water in an agitator. The slurry is spray dried. The spray dried powder is screened −60 mesh and sintered in hydrogen for about 1 hour at an average temperature of about 900° C. The bulk density of the sintered powder is about 1.86 g/cc. The sintered powder is then plasma processed by entraining the sintered powder in an inert carrier gas and using argon or a mixture of argon and hydrogen as the plasma gas. The oxygen content in the product powder is about 1.5% by weight. X-ray analysis of the spray dried material shows Mo and a solid solution of Ni. The sintered material shows the presence of $Cr_2B_3$ and $Ni_3Si$. Energy dispersive x-ray analysis shows no interdiffusion between the two regions. The plasma densified material shows in addition to Mo, several new intermetallic phases: CrMoNi, MoNiSi, and CrFeMoSi. By contrast the conventional blended powder only shows Mo and Ni in solid solution. Table 1 describes the variations in the phases obtained in the powder and the coating of the alloy with the powder of the present invention at various points in the processing.

TABLE 1

| Material condition | Phases |
|---|---|
| Sintered powder | Mo, Ni solid solution (major)<br>$Cr_2B_3$ and $Ni_3Si$ (minor) |
| Densified powder | Mo solid solution (major) |

TABLE 1-continued

| Material condition | Phases |
|---|---|
| | Ni-s.s, CrMoNiSi, CrFeMoNi (minor) |
| Plasma spray coating | Mo-solid solution (major) |
| | Ni-s.s, FeMo, $Ni_3B$ (minor) |

Figure 1B:
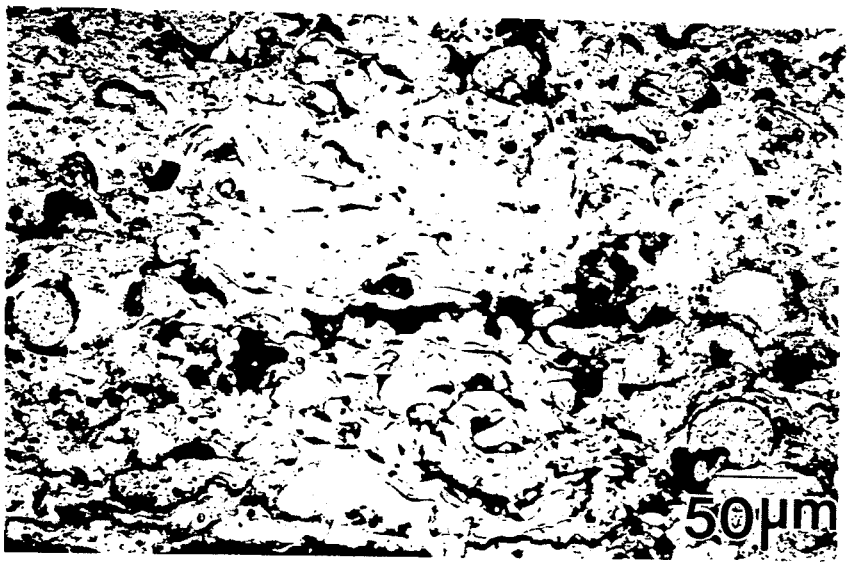
FIG. 1*b* is an optical micrograph at 200× magnification showing a coating made from powders of the present invention.

FIG. 1*a* is an optical micrograph at 200× magnification showing a coating made from powders produced by prior blending methods. FIG. 1*b* is an optical micrograph at 200× magnification showing a coating made from powders produced by the present invention including the plasma processing steps as described in the Example. It can be seen that the coating produced from powder of the present invention shows a uniform and fine distribution of various phases in the matrix.

Figure 2A:
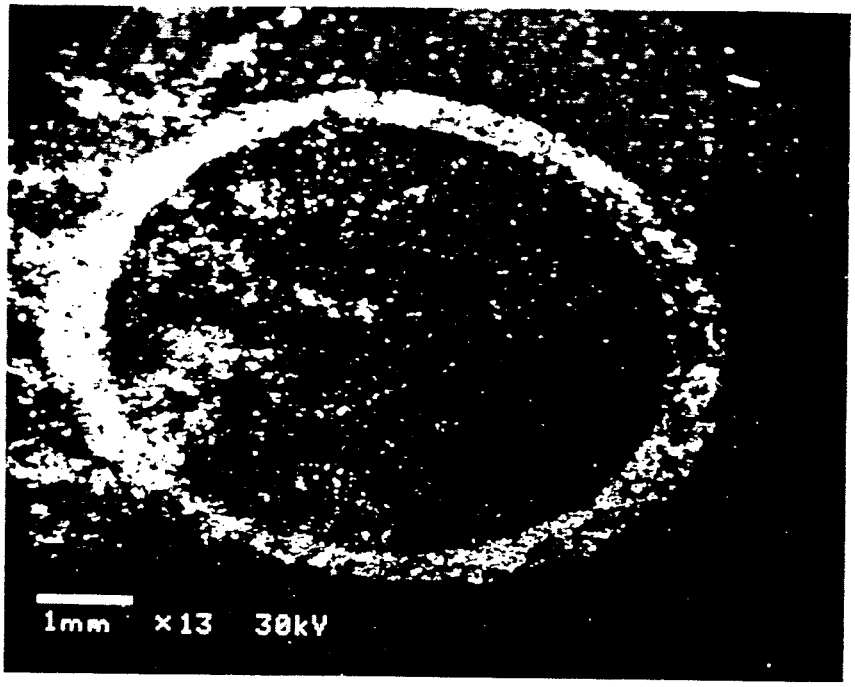
FIGS. 2*a*, 2*b*, and 2*c* are scanning electron micrographs showing wear test results on coatings made from prior blended powders.
Figure 2B:
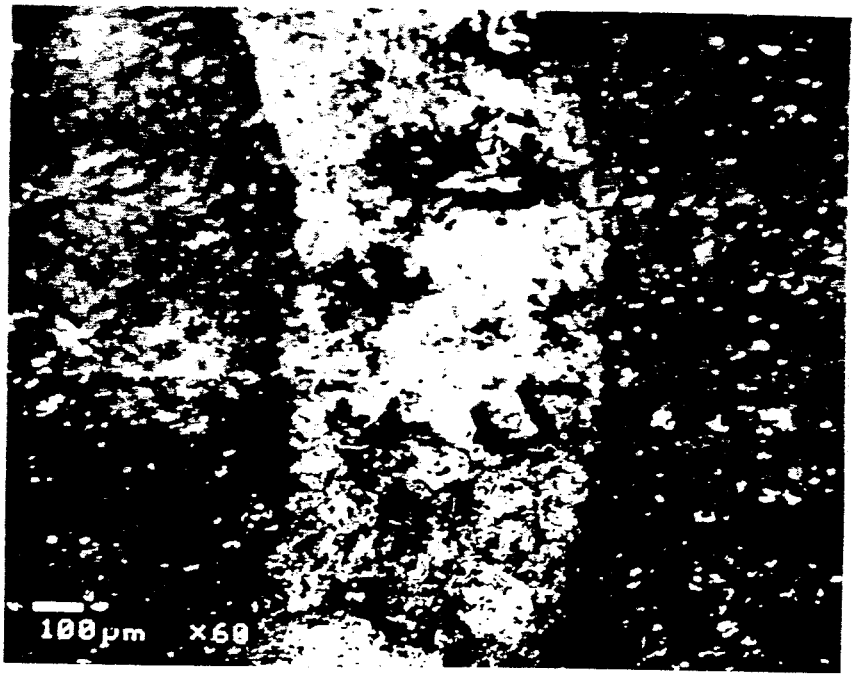
Figure 2C:
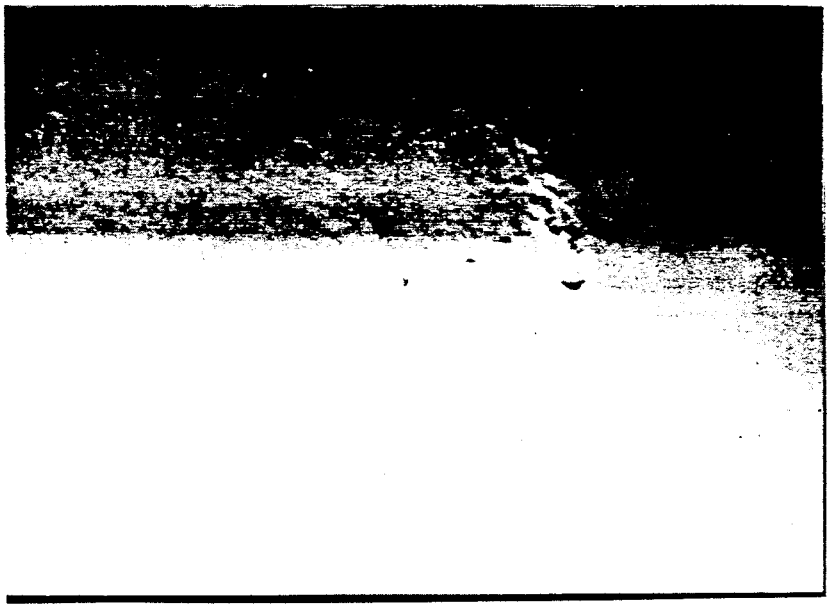
Figure 3C:
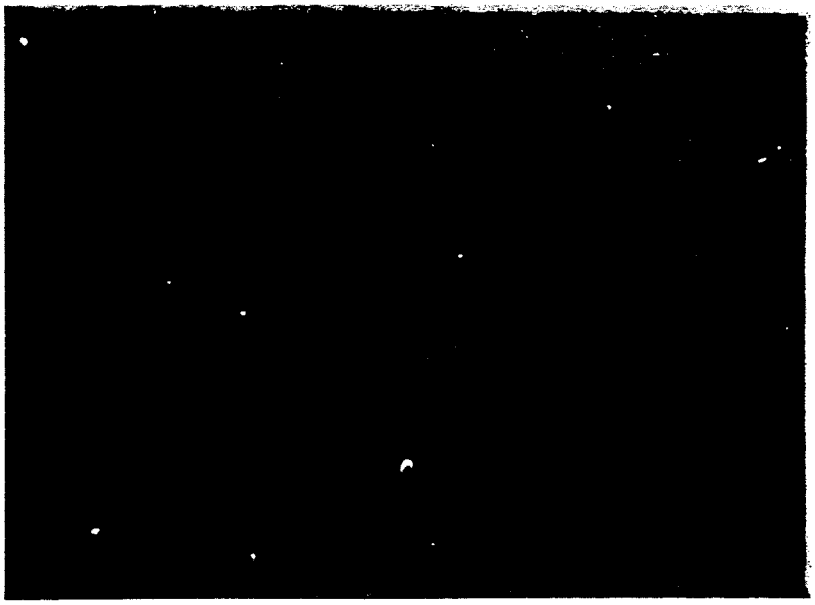
FIGS. 3*a*, 3*b*, and 3*c* are scanning electron micrographs showing wear test results on coatings made from powders of the present invention.
Figure 3A:
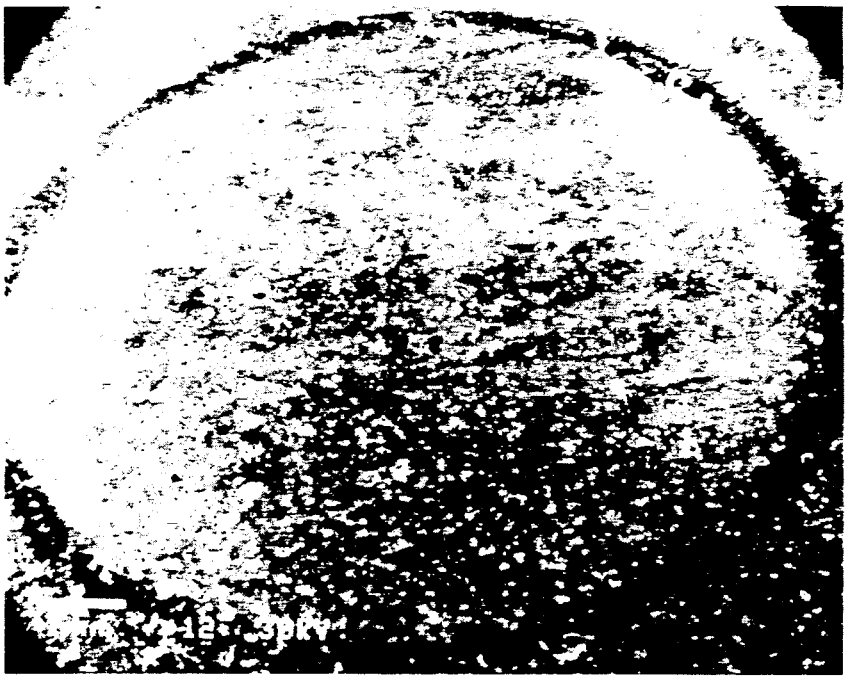
Figure 3B:
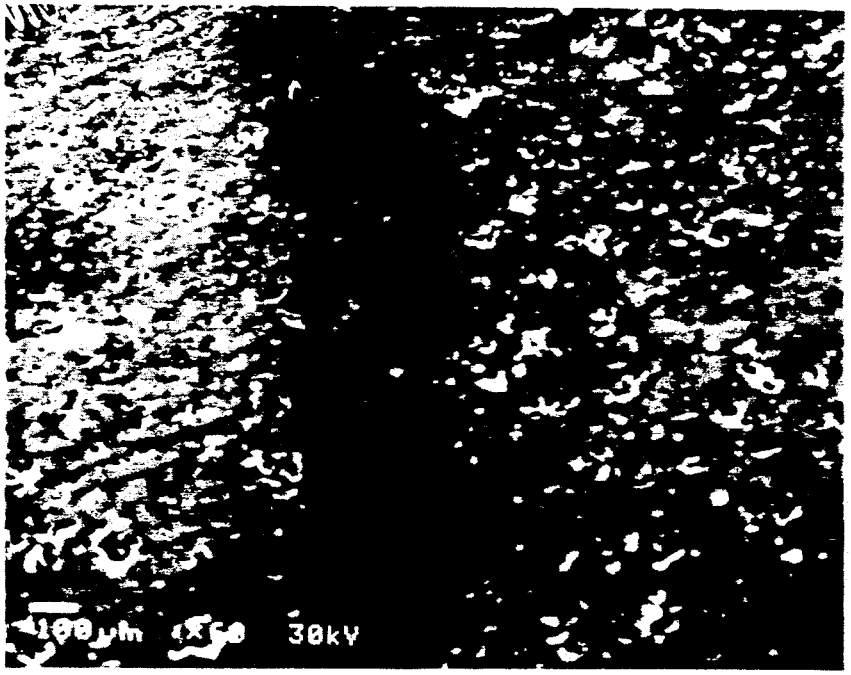
Figure 4B:
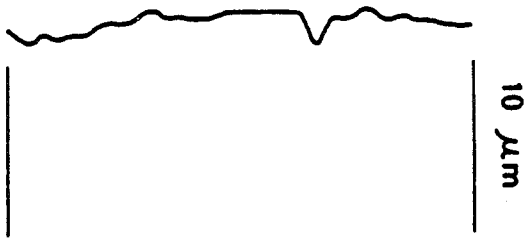
FIG. 4*a* and *b* shows profilometry data of the wear on the coatings made from prior blended powders and from the powders of the present invention.

Scanning electron microscopy and profilometry are conducted to observe wear track and scar depth data respectively. FIGS. 2*a*, 2*b*, and 2*c* are scanning electron micrographs (SEM) showing wear test results using ball-on disk test apparatus on coatings made from prior blended powders. FIGS. 3*a*, 3*b*, and 3*c* show the same with powders of the present invention as described above. FIGS. 2*a* and 3*a* are of the coated disk at 60× magnification. FIGS. 2*b* and 3*b* are of the coated disk at 200× magnification. FIGS. 2*c* and 3*c* are of the mating surface which is a hardened AISI 440-C steel ball. The tests are conducted using 1 Kg load on the disk. The sliding velocity is 0.2 m/sec and the sliding distance is 500 meters. Scar depth results are shown in FIG. 4 for prior powders and powders of this invention as described above with molybdenum metal as a reference. FIGS. 3*a*, 3*b*, and 3*c* and FIG. 4 show significant improvement in wear performance of coatings made from the present invention over commercial coatings made from blended powder.

Figure 5:
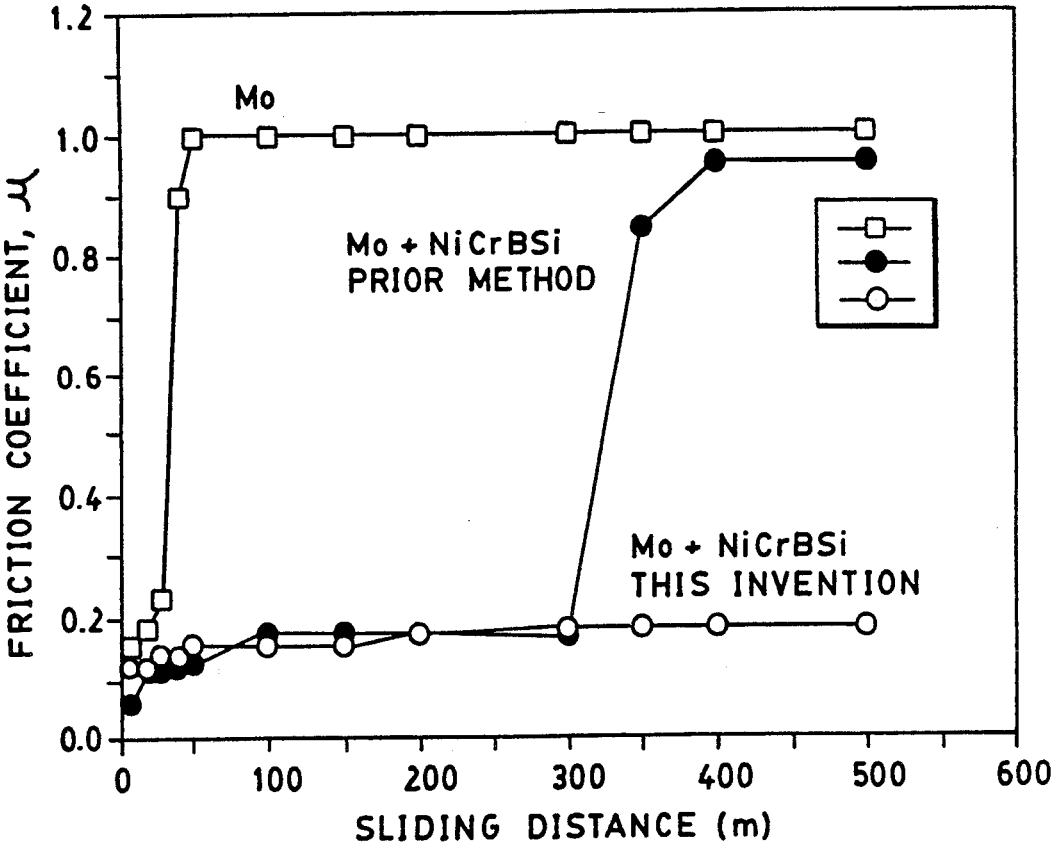
FIG. 5 is a plot of the friction coefficient versus sliding distance in meters for plasma sprayed coatings using the powder of the present invention and with powders produced by prior conventional blending techniques.

FIG. 5 is a plot showing the friction coefficient for plasma sprayed coatings using the powder of the present invention and with powders produced by prior conventional blending techniques. FIG. 5 shows that the coating using the powder of the present invention maintains a lower coefficient of friction when tested against AISI 440-C hardness steel ball.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for preparing an intimate mixture of powders of nickel-boron-silicon alloy and molybdenum metal powder suitable for thermal spray coatings, said method comprising:

a) milling a starting mixture of said nickel-boron-silicon alloy and molybdenum powder to produce a milled mixture wherein the average particle size is less than about 10 micrometers in diameter;

b) forming an aqueous slurry of the resulting milled mixture and a binder selected from the group consisting of an ammoniacal molybdate compound and polyvinyl alcohol; and c) agglomerating said milled mixture and said binder to produce said intimate mixture.

2. A method of claim 1 comprising the additional step of sintering said intimate mixture and said binder in a reducing atmosphere at a temperature of about 800° C. to about 950° C. for a sufficient time to form a sintered partially alloyed mixture wherein the bulk density is greater than about 1.2 g/cc.

3. A method of claim 2 comprising the additional steps of:

a) entraining the resulting sintered mixture in an inert carrier gas;

b) passing said sintered mixture and said carrier gas into a plasma flame wherein the plasma gas is selected from the group consisting of argon and a mixture of argon and hydrogen, and maintaining said sintered mixture in said plasma flame for a sufficient time to melt essentially all of the powder particles of said sintered mixture to form spherical particles of the melted portion, and to further alloy said sintered mixture; and c) cooling the resulting further alloyed mixture.

4. A method of claim 1 wherein said binder is ammonium paramoybdate.

5. A method of claim 1 wherein said binder is polyvinyl alcohol.

6. A method of claim 1 wherein said agglomerating is done by spray drying said aqueous slurry.

7. A method of claim 1 wherein said nickel-boron-silicon alloy consists essentially of in percent by weight about 1 to about 20 chromium, about 2 to about 5 boron, about 2 to about 5 silicon, about 0.1 to about 2 carbon, and the balance nickel.

8. A method of claim 1 wherein said starting mixture of said nickel-boron-silicon alloy and said molybdenum powder consists essentially of in percent by weight about 10 to about 50 of said nickel-boron-silicon alloy and the balance said molybdenum powder.

9. A method of claim 8 wherein said starting mixture consists essentially of in percent by weight about 20 to about 40 of said nickel-boron-silicon alloy and the balance said molybdenum powder.

* * * * *

UNITED STATES PATENT AND TRADEMARK OFFICE

CERTIFICATE OF CORRECTION

PATENT NO. : 5,063,021

DATED : November 5, 1991

INVENTOR(S) : Vidhu Anand, Sanjay Sampath, Clarke D. Davis, and David L. Houck

It is certified that error appears in the above-identified patent and that said Letters Patent is hereby corrected as shown below:

Column 1, line 34 - delete "progagation" and substitute therefor --propagation--;

Column 5, line 29 - delete "0.2m/sec" and substitute therefor --0.01m/sec--;

Column 5, line 30 - delete "500" and substitute therefor --50--;

Column 6, line 34 - delete "parmoybdate" and substitute therefor --paramolybdate--.

Signed and Sealed this

Fourth Day of May, 1993

*Attest:*

*Attesting Officer*

Michael K. Kirk

MICHAEL K. KIRK

*Acting Commissioner of Patents and Trademarks*